US007748467B2

(12) United States Patent
Doane

(10) Patent No.: US 7,748,467 B2
(45) Date of Patent: Jul. 6, 2010

(54) DOWNHOLE SEAL APPARATUS AND METHOD

(75) Inventor: James C. Doane, Friendswood, TX (US)

(73) Assignee: Baker Hughes Incorporated, Houston, TX (US)

( * ) Notice: Subject to any disclaimer, the term of this patent is extended or adjusted under 35 U.S.C. 154(b) by 48 days.

(21) Appl. No.: 11/949,470

(22) Filed: Dec. 3, 2007

(65) Prior Publication Data

US 2008/0296844 A1 Dec. 4, 2008

Related U.S. Application Data

(63) Continuation of application No. 11/755,962, filed on May 31, 2007, now abandoned.

(51) Int. Cl.
*E21B 33/10* (2006.01)

(52) U.S. Cl. ..... 166/387; 166/134; 277/338; 277/636

(58) Field of Classification Search ..... 166/387, 166/134, 182; 277/338, 607, 636, 644
See application file for complete search history.

(56) References Cited

U.S. PATENT DOCUMENTS 2,501,943 A * 3/1950 Jack ..... 277/615
2,976,543 A * 3/1961 Turner et al. ..... 4/252.6
4,475,845 A * 10/1984 Odill et al. ..... 404/25
4,516,731 A * 5/1985 Prince et al. ..... 241/24.16
4,588,029 A 5/1986 Blizzard
4,702,481 A 10/1987 Brammer
5,129,658 A * 7/1992 Berton et al. ..... 277/591
5,311,938 A * 5/1994 Hendrickson et al. ..... 166/134
5,333,692 A 8/1994 Baugh et al.
5,511,620 A 4/1996 Baugh et al.
5,615,794 A * 4/1997 Murray, Jr. ..... 220/304

(Continued)

FOREIGN PATENT DOCUMENTS

GB 2 276 647 10/1994

(Continued)

OTHER PUBLICATIONS

International Search Report with Written Opinion, PCT/US2008/064992, Date Mailed Sep. 2, 2008. Search Report having 6 pages, Written Opinion having 5 pages.

(Continued)

*Primary Examiner*—William P Neuder
(74) *Attorney, Agent, or Firm*—Cantor Colburn LLP

(57) ABSTRACT

Disclosed herein is a tubular seal apparatus. The seal apparatus includes, a first tubular positioned coaxially with a second tubular having an annular space therebetween, a frustoconical portion at the first tubular having a first end and a second end, such that a radial dimension of the annular space is larger at the first end than at the second end and a tubular seal positioned within the annular space. The seal apparatus further includes an urging member in operable communication with the tubular seal, the urging member is axially movable relative to the frustoconical portion such that movement of the urging member toward the second end of the frustoconical portion urges the tubular seal into sealing engagement with the frustoconical portion and causes diametrical deformation of the tubular seal to thereby sealingly engage with the second tubular.

31 Claims, 5 Drawing Sheets

U.S. PATENT DOCUMENTS

| | | | | |
|---|---|---|---|---|
| 5,988,276 | A | 11/1999 | Oneal | |
| 6,182,755 | B1 | 2/2001 | Mansure | |
| 6,705,615 | B2 | 3/2004 | Milberger et al. | |
| 6,860,487 | B2 * | 3/2005 | Shiokawa et al. | 277/607 |
| 6,896,049 | B2 | 5/2005 | Moyes | |
| 6,962,206 | B2 | 11/2005 | Hirth et al. | |
| 7,134,506 | B2 | 11/2006 | Moyes | |
| 2003/0193145 | A1 | 10/2003 | Reimert et al. | |

FOREIGN PATENT DOCUMENTS

| | | |
|---|---|---|
| GB | 2 381 546 | 5/2003 |

OTHER PUBLICATIONS

Ross, Elsie. "Closing the Gap: New Seal Technologies, More Reliable, Easier to Use." Well Optimization and Enhanced Recovery. New Technology Magazine. Calgary: having 2 pages. Dec. 21, 2007.

Urband, Bruce E. "CRA Clad Downhole Tubing—An Economical Enabling Technology." AADE National Drilling Technical Conference, AADE 01-NC-HO-46, Houston, Texas, Mar. 27-29, 2001. 10 pages.

"Caledyne Launches MTM Downhole Seal System". Jul. 9, 2007. Retrieved from Internet on Jun. 17, 2008. http:// rigzone.com/news/article_pf.asp?a_id=47409; 1 page.

Problem Solving Products, Inc.; Kalrez O-Rings and Seals:; copyright 1997-2008; Retrieved from Internet Jun. 17, 2008; http://www.pspglobal.com/kalrez-o-rings/oil-gas-industries.html; 3 pages.

* cited by examiner

DOWNHOLE SEAL APPARATUS AND METHOD

CROSS-REFERENCE TO RELATED APPLICATIONS

This application is a continuation of U.S. application Ser. No. 11/755,962, filed May 31, 2007, the entire contents of which is incorporated herein by reference.

BACKGROUND OF THE INVENTION

In the hydrocarbon recovery industry it is often necessary to seal tubulars to one another in a downhole environment. Packers, for example, typically employ seals with packing elements that when actuated seal one tubular to another tubular. These seals can be complicated assemblies that require significant actuation forces to set as well as to maintain their seal integrity. Additionally, the reliability and durability of these seals in the high pressure, high temperature and caustic environments encountered downhole can be questionable. As such, a reliable downhole tubular to tubular seal that is easy to set would be welcomed in the art.

BRIEF DESCRIPTION OF THE INVENTION

Disclosed herein is a tubular seal apparatus. The seal apparatus includes, a first tubular positioned coaxially with a second tubular having an annular space therebetween, a frustoconical portion at the first tubular having a first end and a second end, such that a radial dimension of the annular space is larger at the first end than at the second end and a tubular seal positioned within the annular space. The seal apparatus further includes an urging member in operable communication with the tubular seal, the urging member is axially movable relative to the frustoconical portion such that movement of the urging member toward the second end of the frustoconical portion urges the tubular seal into sealing engagement with the frustoconical portion and causes diametrical deformation of the tubular seal to thereby sealingly engage with the second tubular.

Further disclosed herein is a method of sealing downhole tubulars. The method includes, positioning a tubular seal in an annular space between a first tubular and a second tubular, axially urging the tubular seal against a frustoconical portion of the first tubular thereby sealingly engaging the tubular seal with the frustoconical portion and diametrically deforming the tubular seal thereby sealingly engaging the tubular seal with the second tubular.

A seal includes a first tubular portion; a second tubular portion fixedly attached to the first tubular portion; a bellows making up at least a portion of one of the first tubular portion and the second tubular portion, the other of the first tubular portion and the second tubular portion being sealably interactive with the bellows when the seal is set.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of several embodiments of the disclosed apparatus and method are presented herein by way of exemplification and not limitation with reference to the Figures.

Figure 1:
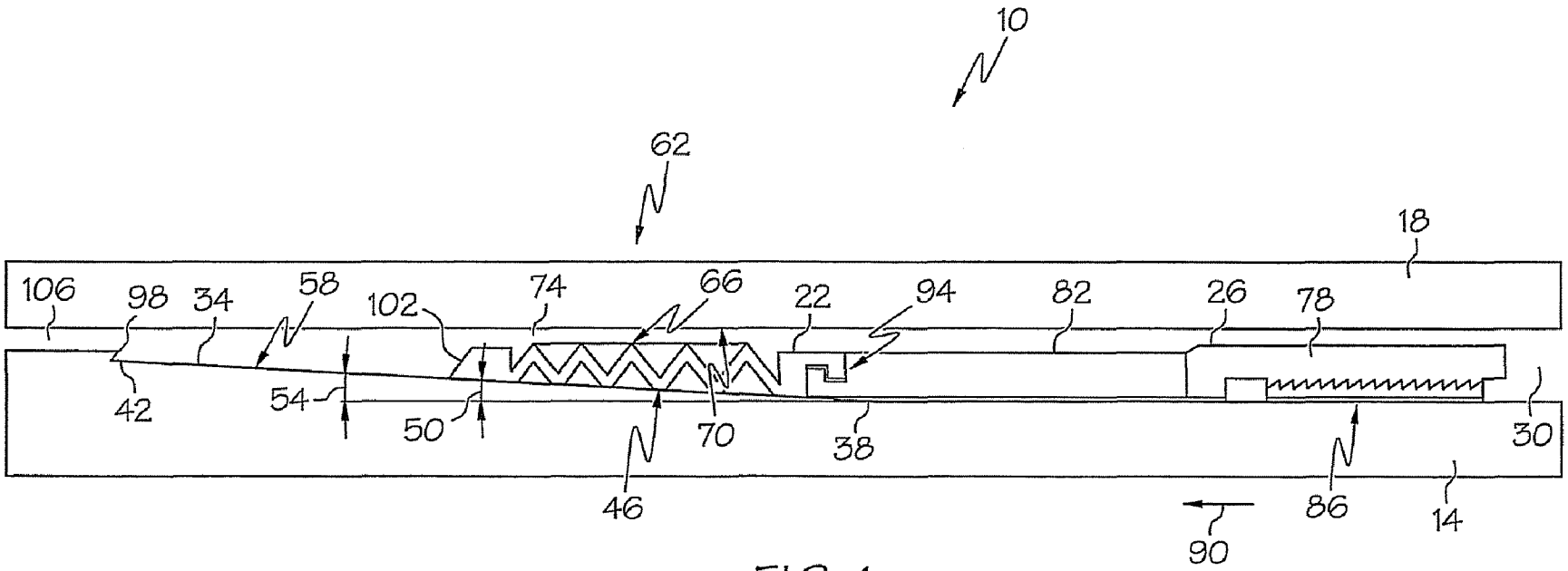
FIG. 1 depicts a partial cross sectional view of a tubular seal apparatus disclosed herein in a seal open configuration.

Referring to FIG. 1 a partial cross sectional view of an embodiment of the tubular seal apparatus 10 disclosed herein is illustrated. The tubular seal apparatus 10 is interengagable with a first tubular 14. The tubular seal 22 itself includes a number of components discussed hereunder and is in operable communication with an urging member 26 when assembled for use. The seal apparatus is illustrated positioned between the first tubular 14 and a second tubular 18. Although a seal is directly discussed herein, it is to be appreciated that the seal surface may also be configured as an anchoring surface with simply a roughened surface thereof. Thus where the term "seal" is used herein, it is intended that anchoring configuration is also intended. Because the seal or anchoring apparatus disclosed herein is caused to become tightly disposed between two tubular structures, it will be understood that either a seal or an anchor or both could easily be achieved by the arrangement disclosed herein. The first tubular 14, the second tubular 18 and the tubular seal 22 may all be made of a relatively rigid material such as metal, for example, which provides excellent resistance to the high pressure, high temperature and caustic environments often found downhole. Other materials are also contemplated and are elucidated further hereinbelow. The first tubular 14 is generally coaxial with the second tubular 18 such that an annular (or other perimetrical) space 30 is formed therebetween. The first tubular 14 has a frustoconical portion 34 with a first end 38 and a second end 42. A diameter of the frustoconical portion 34 at the first end 38 is smaller than a diameter of the second end 42 such that a radial dimension of the annular space 30 is greater at the first end 38 than at the second end 42. The tubular seal 22 is positioned, in the annular space 30, such that it is coaxial with the tubulars 14, 18. The tubular seal 22 is sealable with both the first tubular 14 and the second tubular 18 to reliably prevent flow through the annular space 30. Such a tubular seal apparatus 10 is usable for sealing tubulars in downhole packers, for example. Details and operation of the tubular seal apparatus 10 will be described below.

The tubular seal 22 is made of a relatively rigid material such as metal, for example (other materials being contemplated and disclosed hereunder), and in the embodiment illustrated is in the shape of a bellows. In one embodiment an inner frustoconical surface 46 is defined by the radially inwardly located points of the bellows. The surface 46 has a divergent angle 50 that substantially matches a divergent angle 54 of an outer frustoconical surface 58 of the frustoconical portion 34. In other embodiments it is also possible to configure surface 46 as a cylindrical surface, an angular surface that is steeper than that of surface 58 of shallower than that of surface 58 while still allowing the seal 22 to deform into the shape illustrated in FIG. 2. While some efficiency of the system is lost by not configuring the surface 46 to closely match the angle 54, a reliable seal is still achievable. In a seal open configuration 62, as shown in the FIG. 1 embodiment, the surfaces 46 and 58 contact each other with the tubular seal 22 positioned at the first end 38 and axially spaced a distance from the second end 42. In the seal open configuration 62 an outer radial surface 66 of the tubular seal 22 is diametrically smaller than an inner radial surface 70 of the second tubular 18 thereby providing an annular flow space 74 therebetween.

The tubular seal 22 is moved axially by the urging member 26. The urging member 26 has a collar portion 78 and a collet portion 82. The collar portion 78 is engagable with and axially movable by any one of a variety of actuators (not shown) that are known in the industry for axial actuation of common downhole devices. These therefore do not require detailed description herein. The collar portion 78 is fixedly engagable with the first tubular 14 by a lock ring disclosed herein as ratchet device 86 that permits axial movement of the urging member 26 in an axial direction according to arrow 90 while not permitting axial movement in a direction opposite to the arrow 90 relative to the first tubular 14. The collet portion 82 includes longitudinal slots (not shown) formed therein to allow the collet portion 82 to expand diametrically outwardly as it urges the tubular seal 22 along the frustoconical portion 34. The collet portion 82 is fixedly attached to the tubular seal 22 by latch detail 94 such that axial movement of the urging member 26 causes a similar axial movement of the tubular seal 22. The attachment of the tubular seal 22 to the urging member 26 by the latch detail 94 also locks in any additional axial movement of the seal due to applied pressure from the right side (in the figure). It is to be appreciated however that the components of the apparatus described herein can be inverted such that the urging member is located at the left side of the figure and that therefore no limitation should attach simply because the figure is illustrated in one way or has been described using a relative side term.

Axial actuation of the urging member 26 in the direction of the arrow 90 urges the tubular seal 22 into sealing engagement with the frustoconical portion 34. Continued motion of the urging member 26 and the tubular seal 22 causes the tubular seal 22 to deform diametrically outwardly, in this embodiment. This diametrical expansion of the tubular seal 22 includes the diametrical expansion of the outer radial surface 66 until the outer radial surface 66 comes into contact with the inner radial surface 70 of the second tubular 18. Sealing engagement results between the tubular seal 22 and the second tubular 18 when adequate contact pressure between the outer radial surface 66 and the inner radial surface 70 is achieved. Adjustments in the force required to axially move the urging member 26 to achieve the necessary contact pressures can be adjusted in the design phase of the tubular seal apparatus 10. More specifically, lower urging forces can be attained by using smaller divergent angles 50, 54, for example, as compared to larger divergent angles 50, 54. Alternate embodiments of the tubular seal apparatus could have the frustoconical portion on an inner radial surface of an outer tubular, for example. In such an embodiment, a tubular seal would be deformed diametrically inwardly due to axial movement of the tubular seal into engagement with the diametrically decreasing dimension of the frustoconical portion. As such, the diametrical deformation of the tubular seal would cause the tubular seal to sealingly engage with an outer radial surface of an inner tubular.

A diametrically protruding bump 98, or step, at the second end 42 of the frustoconical portion 34 is contactable by a leading edge 102 of the tubular seal 22 to prevent the tubular seal 22 from extruding through an annular gap 106 between the first tubular 14 and the second tubular 18 beyond the frustoconical portion 34 in the direction of the arrow 90. The leading edge 102 may have a reversed angle formed thereon that mates with a similar shaped reversed angle on the bump 98 to further discourage extrusion of the tubular seal 22 through the annular gap 106.

Figure 2:
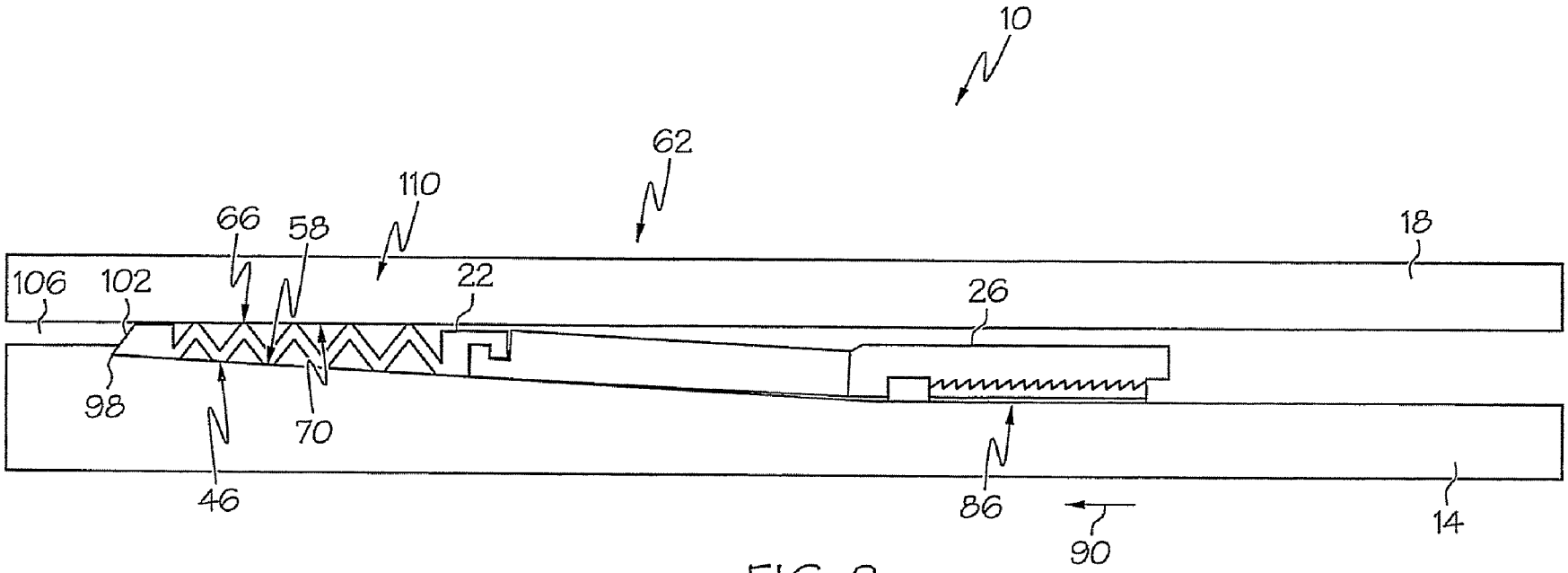
FIG. 2 depicts a partial cross sectional view of the tubular seal apparatus of FIG. 1 in a seal closed configuration.

Referring to FIG. 2, the tubular seal apparatus 10 is illustrated in a seal closed configuration 110. The inner frustoconical surface 46 is in sealing engagement with the outer frustoconical surface 58 and the outer radial surface 66 is in sealing engagement with the inner radial surface 70. The leading edge 102 is in contact with the bump 98 thereby preventing the tubular seal 22 from extruding through the annular gap 106. Maintaining the seal between the tubular seal 22 and the tubulars 14, 18 upon release of a force urging the urging member 26 and the tubular seal 22 in the direction of the arrow 90 is facilitated by material choice and the incorporation of one or more grooves in the tubular seal 22 as will be described below.

Figure 3:
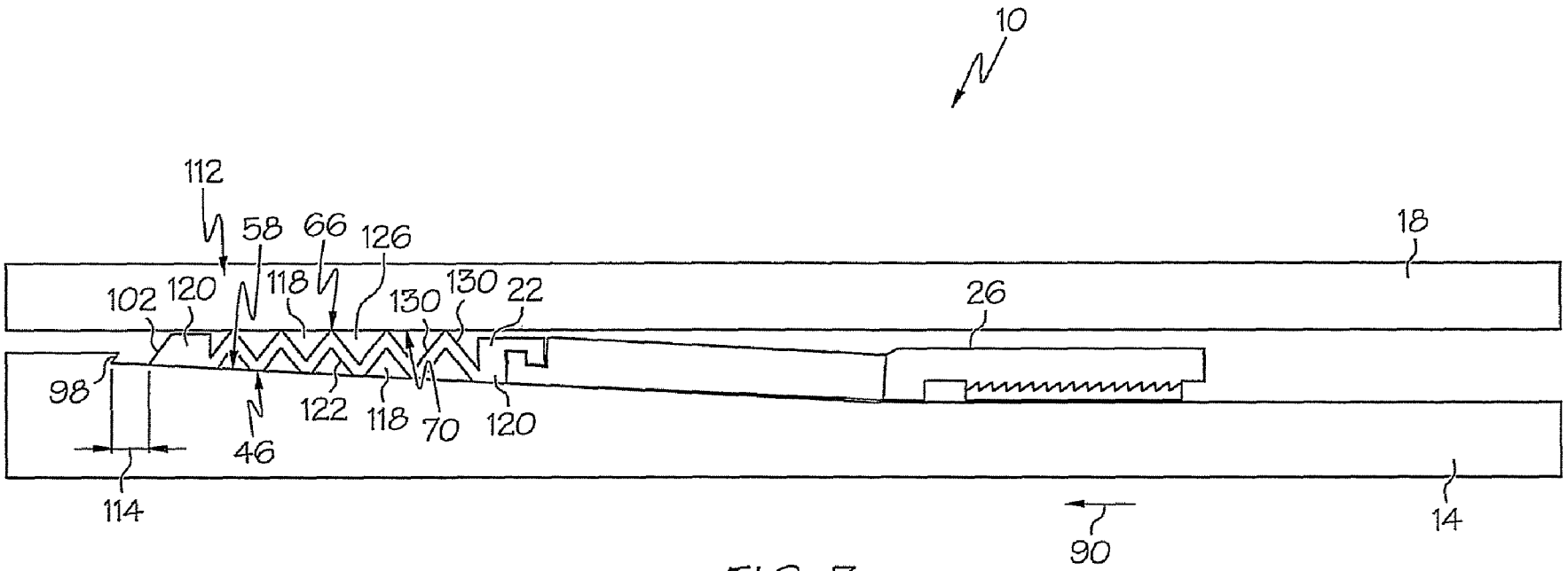
FIG. 3 depicts a partial cross sectional view of the tubular seal apparatus of FIG. 1 in a seal closed configuration.

Referring to FIG. 3, the tubular seal apparatus 10 is illustrated in a seal closed configuration 112. As with most common ratchet devices 86, upon release of a force urging the urging member 26 in the direction of the arrow 90 there may be a small amount of reverse axial movement of the urging member 26 until the ratchet device 86 is fully engaged. This small amount of reverse axial movement of the urging member 26 also allows for a similar reverse axial movement of the tubular seal 22. Such a reverse axial movement of the tubular seal 22 is revealed by an axial gap 114 between the leading edge 102 and the bump 98. Such an axial gap 114 could result in a potential leak-path between the surfaces 46 and 58, or the surfaces 66 and 70, if the deformation of the tubular seal 22 were completely plastic with no elastic component.

Incorporating one or more grooves 118 in the inner frustoconical surface 46, or the outer radial surface 66, between non-grooved end portions 120, can increase the elasticity of the tubular seal 22 as compared to tubular seals 22 that do not include the grooves 118. This increase in elasticity is due to the creation of beams 122 that can flex over a length of the beam 122 thereby providing for a greater deflection before exceeding the elastic limit of the material. Thus, even after significant plastic deformation, through the diametrical expansion of the tubular seal 22, the elastic deformation of the beam 122 will remain allowing for greater variations in the radial dimension between the inner radial surface 70 and the outer frustoconical surface 58 over which the tubular seal 22 can maintain sealing engagement. The dimensions and quantity of the grooves 118 utilized can be optimized per application to provide the robustness desired at the sealing pressures needed.

Robustness of the sealing integrity between the tubular seal 22 and the tubulars 14, 18 can be increased even further through the incorporation of a filler material 126 in the grooves 118 or a coating covering one or more surfaces of the seal 22. The filler material 126 can add to the robustness in two ways. First, by having elastomeric properties the filler material 126 can seal around imperfections in the surfaces 46, 58, 66 and 70. And second, the filler material 126 can prevent sides 130 of the groove 118 from collapsing against one another. The coating material can improve sealing by ensuring that imperfections in the mating seal surfaces do not become leak paths by flowing into these imperfections. Both the filler material for the grooves or the coating materials disposed at one or both surfaces of the seal 22, may be of a relatively soft material such as soft metal like copper, gold, silver, palladium, platinum, tin, lead, bismuth, etc, or alloys of these metals that can be applied to the seal by such methods as plating, brazing, thermal spray, sputtering, etc. or elastomers, or plastic materials such as Teflon, Polyetheretherketones (PEEK), etc. that can be applied and/or bonded by various industry recognized processes. Such materials enhance the sealing operation by deforming easily into imperfections in any of the mating seal surfaces as well as geometric variations in the seal due to eccentric bending that may occur therein.

Figure 4:
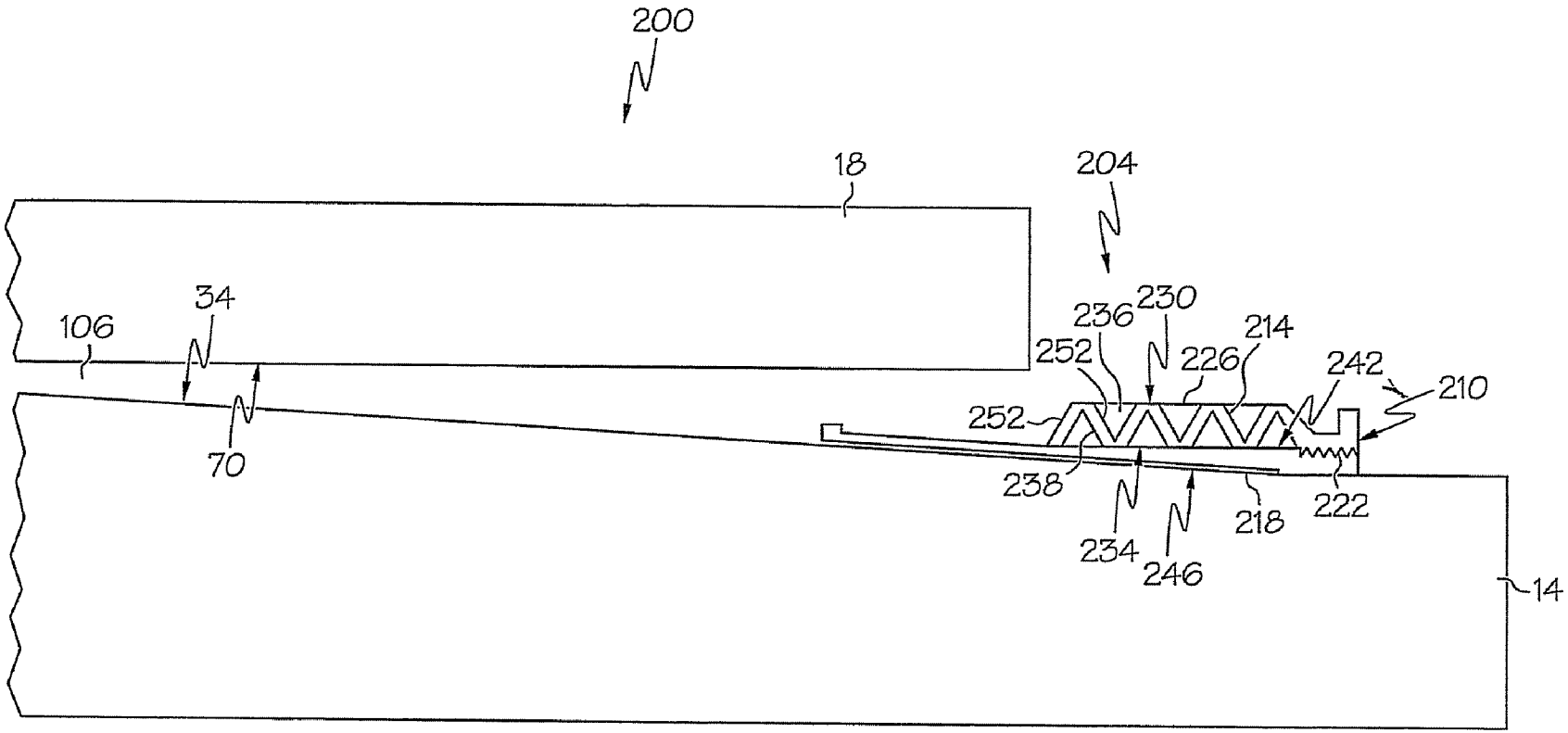
FIG. 4 depicts a partial cross sectional view of an alternate tubular seal apparatus disclosed herein.

Referring to FIG. 4, an alternate tubular seal apparatus 200, disclosed herein, is illustrated in a seal open configuration 204. The tubular seal apparatus 200 includes the first tubular 14, a tubular seal 210 and an urging member (not shown) that is similar to the urging member 26, positioned within the second tubular 18. The tubular seal 210 includes a first tubular portion 214 and a second tubular portion 218. The tubular portions 214, and 218 are made of a relatively rigid material such as metal, for example (or the materials indicated in paragraph [0021] herein. The first tubular portion 214 is fixedly attached to the second tubular portion 218 by fixing means known in the industry such as by threads 222, for example. Similar to the tubular seal apparatus 10 the first tubular portion 214 has a plurality of grooves 226 at an outer radial surface 230 and a plurality of grooves 226 formed at an inner radial surface 234 thereof. The grooves 226 are located such that the first tubular portion 214 resembles a pleated bellows, the significance of which will be described below. The grooves 226 may be filled with a filler material 236 that is a material different than the material of the first tubular portion 214 and aids in sealing and in preventing the grooves 226 from collapsing or the grooves may be left as voids. Materials and methods for applying such materials in this embodiment are identical to those described with reference to the first disclosed embodiment and detailed in paragraph [0021] above. In this embodiment, both of the radial surfaces 230 and 234 have substantially constant radial dimensions such that each pleat 238 of the first tubular portion 214 is substantially geometrically similar to all of the other pleats 238.

The inner radial surface 234 of the first tubular portion 214 rests diametrically flush against an outer radial surface 242 of the second tubular portion 218. The outer radial surface 242 has a substantially constant radial dimension while an inner frustoconical surface 246 of the second tubular portion 218 has a frustoconical shape with substantially a same angle of divergence as that of the frustoconical portion 34 of the first tubular 14. As in the first disclosed embodiment, the angle of this component may be varied without ultimate loss of sealing integrity but with minimal loss of setting efficiency. As the tubular seal 210 is urged up the frustoconical portion 34 the second tubular portion 218 expands diametrically outwardly. The outer radial surface 242 also expands diametrically outwardly causing the first tubular portion 214 to expand diametrically outwardly as well. This outward diametrical expansion continues until the outer radial surface 230 sealingly engages with the inner radial surface 70 of the second tubular 18.

The seal of the annular gap 106 by the tubular seal 210 allows pressure in the annular gap 106 on a side of the tubular seal 210 (which is the uphole side in this figure) opposite a side of the tubular seal 210 on which the threads 222 are located, to build without leaking by the tubular seal 210. The tubular seal 210 is constructed such that as the uphole pressure increases the sealing pressure, between the first tubular portion 214 and the two surfaces 70, 242 to which the first tubular portion 214 is sealed, also increase. This is due, in part, to a response of the bellows geometry, of the first tubular portion 214, to the pressure increase. The pressure increase acts against the first tubular portion 214 in a direction to collapse the grooves 226 upon themselves. In order for the grooves 226 to collapse, however, each side 252 of each of the grooves 226 would need to move closer to one another. Moving the two sides 252 towards one another, however, causes the volume therebetween to decrease that in turn creates an extruding force on the filler material 236 positioned within each of the grooves 226. This extruding force on the filler material 236 increases the sealing pressure between the filler material 236 and the surfaces 70, 242. Additionally, the sides 252 of each groove 226 are substantially straight segments (in the cross sectional view) that are loaded in compression between the two surfaces 70, 242 as the pressure from uphole or downhole depending upon orientation of the seal acts to collapse the grooves 226. This action of wedging these sides 252 between the surfaces 70, 252 causes the sealing pressure between the first tubular portion 214 and the surfaces 70, 252 to increase thereby improving the seal integrity further. The second tubular portion also allows the seal to be pushed up the ramp without compressing the bellows.

In addition to the foregoing, the surface 246 may be coated with any of the materials disclosed in paragraph [0021] above or the seal 22 may be composed made entirely or in part of the enumerated materials of other similar materials having properties useful in the downhole environment such as resistance to the chemical and thermal environment in the wellbore. Moreover, the seal 22 may either in combination or alternatively be configured with an additional seal configuration such as a rib, an o-ring or other material in a groove, etc. in order to ensure that no leak path can develop between the surface 246 and the surface of the frustoconical section 34. It is further to be appreciated that the coating or rib, etc, could be positioned on the surface of frustoconical section 34 instead or in addition to at surface 246 with substantially similar results.

Figure 5:
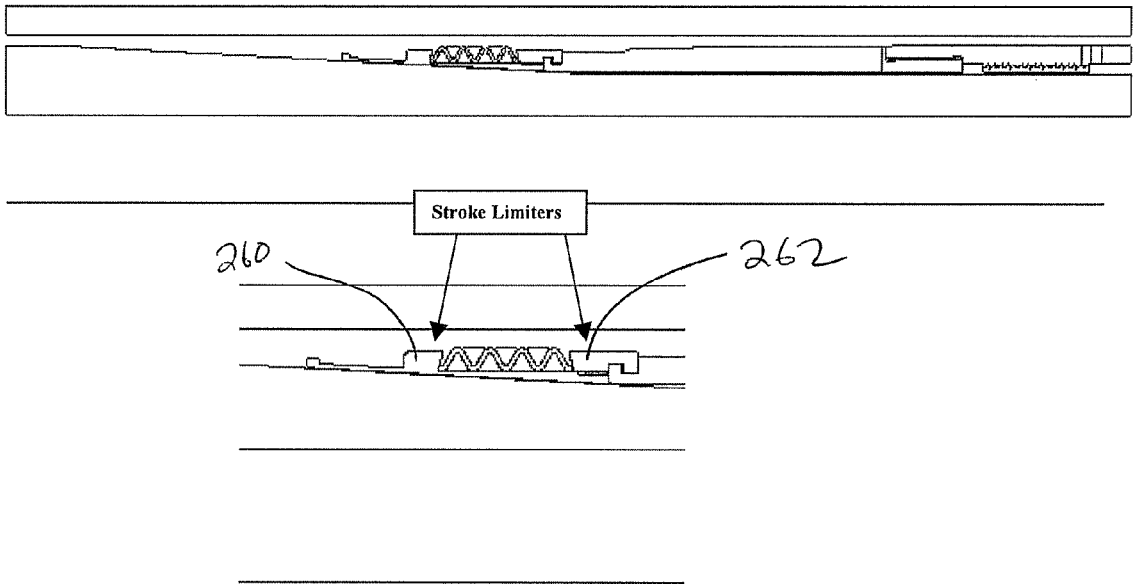
FIG. 5 depicts a partial cross sectional view of an alternate tubular seal apparatus disclosed herein.

In yet another embodiment hereof, referring to FIG. 5, the embodiment of FIG. 4 is modified to include stroke limiters 260 and 262. These features are configured to bridge the annular space 30 between the first tubular 14 and the second tubular 18 at a selected moment relative to the setting of the seal 210 to prevent the seal from being overstroked. In all other respects, the seal is as discussed with respect to FIG. 4.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A tubular seal apparatus, comprising:

a first tubular positioned coaxially with a second tubular having an annular space therebetween;

a frustoconical portion at the first tubular, the frustoconical portion having a first end and a second end, such that a radial dimension of the annular space is larger at the first end of the frustoconical portion than a radial dimension of the annular space at the second end of the frustoconical portion;

a tubular seal positioned within the annular space; and an urging member in operable communication with the tubular seal, the urging member being axially movable relative to the frustoconical portion such that movement of the urging member toward the second end of the frustoconical portion urges the tubular seal into sealing engagement with the frustoconical portion and causes diametrical deformation of the tubular seal to thereby sealingly engage with the second tubular, the urging member having a collet portion having longitudinal slots therein to allow diametrical deformation of the collet portion in response to the collet portion engaging the frustoconical portion.

2. The tubular seal apparatus of claim 1, wherein the frustoconical portion is disposed at an outer radial surface of the first tubular.

3. The tubular seal apparatus of claim 1, wherein the frustoconical portion has a bump at the second end that prevents axial movement of the tubular seal therebeyond.

4. The tubular seal apparatus of claim 1, wherein the tubular seal has at least one circumferential groove therein.

5. The tubular seal apparatus of claim 4, wherein the application of pressure on the seal causes walls of the circumferential groove to get closer together.

6. The tubular seal apparatus of claim 4, wherein the at least one circumferential groove is at an outer radial surface of the tubular seal.

7. The tubular seal apparatus of claim 4, wherein the at least one circumferential groove comprises at least one circumferential groove at an outside radial surface of the tubular seal and at least one circumferential groove at an inside radial surface of the tubular seal.

8. The tubular seal apparatus of claim 4, wherein the at least one circumferential groove is filled with a material other than the material from which the tubular seal is made.

9. The tubular seal apparatus of claim 4, wherein the at least one circumferential groove provides an increase in elastic deformation of the tubular seal as compared to the tubular seal without the at least one circumferential groove.

10. The tubular seal apparatus of claim 1, wherein the tubular seal is made of metal.

11. The tubular seal apparatus of claim 1, wherein the collet portion is axially fixed to the tubular seal.

12. The tubular seal apparatus of claim 1, wherein the urging member is axially fixable to the first tubular with a lock ring.

13. The tubular seal apparatus of claim 1, wherein the tubular seal has a frustoconical surface that contacts the frustoconical portion.

14. The tubular seal apparatus of claim 13, wherein the frustoconical surface has substantially a same angle of divergence as an angle of divergence of the frustoconical portion.

15. The tubular seal apparatus of claim 1, wherein the tubular seal is a packer seal.

16. The tubular seal apparatus of claim 1, wherein the first tubular is positioned radially inwardly of the second tubular.

17. The tubular seal apparatus of claim 1, wherein the tubular seal is comprised of two tubular portions, a first tubular portion having at least one circumferential groove therein and a second tubular portion having an inner frustoconical surface with substantially a same angle of divergence as an angle of divergence of the frustoconical portion.

18. The tubular seal apparatus of claim 17, wherein an outer radial surface of the second tubular portion has a substantially constant radial dimension and an inner radial dimension of the first tubular portion engages with the outer radial surface of the second tubular portion.

19. A method of sealing downhole tubulars, comprising:

positioning a tubular seal in an annular space between a first tubular and a second tubular, the second tubular being substantially coaxial with the first tubular;

axially urging the tubular seal against a frustoconical portion of the first tubular thereby sealingly engaging the tubular seal with the frustoconical portion; and diametrically deforming the tubular seal and a collet engaged therewith thereby sealingly engaging the tubular seal with the second tubular.

20. The method of sealing downhole tubulars of claim 19, wherein the diametrically deforming further includes expanding the tubular seal diametrically outwardly.

21. The method of sealing downhole tubulars of claim 19, further comprising maintaining sealing of the tubular seal with the first tubular and the second tubular by preventing axial movement of the tubular seal in a direction opposite to a direction of the axial urging.

22. The method of sealing downhole tubulars of claim 19, further comprising forming at least one circumferential groove in the tubular seal thereby increasing a sealing pressure between the tubular seal and at least one of the frustoconical portion and the second tubular.

23. The method of sealing downhole tubulars of claim 22, further comprising filling the at least one circumferential groove thereby preventing collapse of the at least one circumferential groove.

24. The method of sealing downhole tubulars of claim 19 further comprising increasing a sealing pressure between the tubular seal and at least one of the first tubular and the second tubular in response to an increase in pressure on an axial side of the tubular seal that is opposite to a side of the tubular seal from which the tubular seal is urged.

25. A seal comprising:

a first tubular portion;

a second tubular portion fixedly attached to the first tubular portion;

a bellows making up at least a portion of one of the first tubular portion and the second tubular portion, the other of the first tubular portion and the second tubular portion being sealably interactive with the bellows when the seal is set, the seal being configured to seal to two members defining an annular gap therebetween; and a soft material.

26. The seal as claimed in claim 25 wherein the bellows comprises the soft material.

27. The seal as claimed in claim 25 wherein the seal comprises the soft material.

28. The seal as claimed in claim 25 wherein an outer surface of the seal is of the soft material.

29. The seal as claimed in claim 25 wherein the soft material is a coating.

30. The seal as claimed in claim 25 wherein at least one of the first tubular portion and the second tubular are made of a relatively rigid material.

31. The seal as claimed in claim 30 wherein the relatively rigid material is metal.

* * * * *